United States Patent [19]

Burch

[11] 4,032,876

[45] June 28, 1977

[54] AMBIENT-COMPENSATED CIRCUIT BREAKER

[75] Inventor: Lyndon W. Burch, Boston, Mass.

[73] Assignee: B/K Patent Development, Inc., Highland Park, Ill.

[22] Filed: Oct. 3, 1975

[21] Appl. No.: 619,218

[52] U.S. Cl. ..... 337/75; 337/78; 337/79

[51] Int. Cl.[2] ..... H01H 71/16

[58] Field of Search ..... 337/70, 72, 75, 76, 337/78, 79, 356, 358, 359, 362

[56] References Cited

UNITED STATES PATENTS

| | | | |
|---|---|---|---|
| 2,496,759 | 2/1950 | Warsher | 337/79 X |
| 3,761,855 | 9/1973 | Townsend | 337/78 |

*Primary Examiner*—George Harris

[57] ABSTRACT

An ambient-compensated, current-actuated circuit breaker, adapted to be miniaturized. In one embodiment, the device has a movable spring arm with contact portion mounted on a base; a plural-legged, current sensitive monometallic element is mounted on the base with the legs joined at an upper end and spread apart to form a rigid structure, the current-sensitive element having a combined contact and latch portion at one end which engages the spring arm in a contact-closed position, the force of the spring arm being in a direction in which the current sensitive element is rigid. Upon heating a proper one or more of the legs by electrical current, the heated leg or legs elongate and move the upper end portion and latch portion in a direction to release the spring arm and open the contacts. An equal change in temperature of all the legs will not trip the latch.

20 Claims, 26 Drawing Figures

FIG. 1
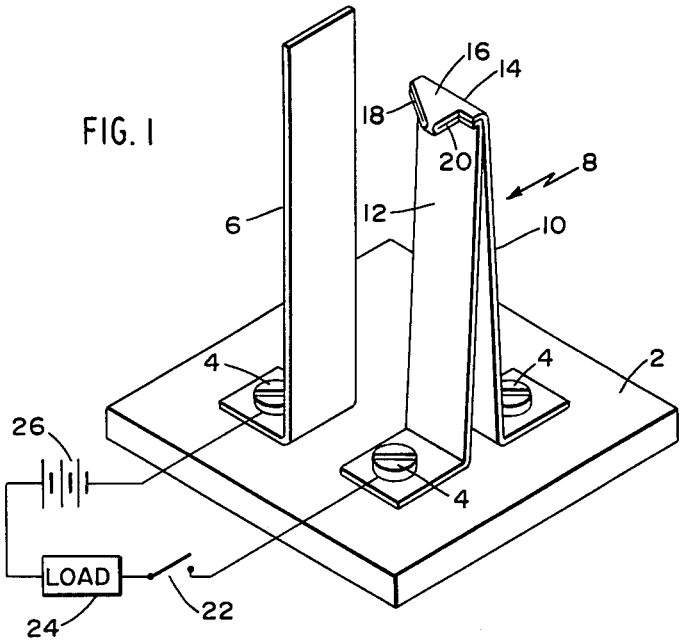
FIG. 2
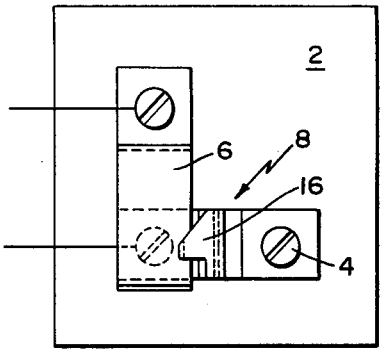
FIG. 5
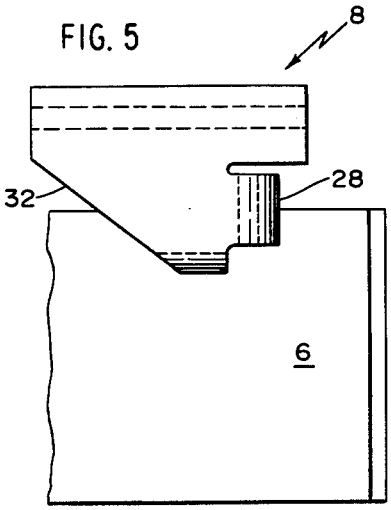
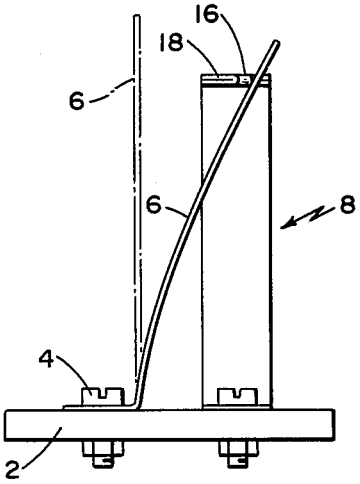
FIG. 3
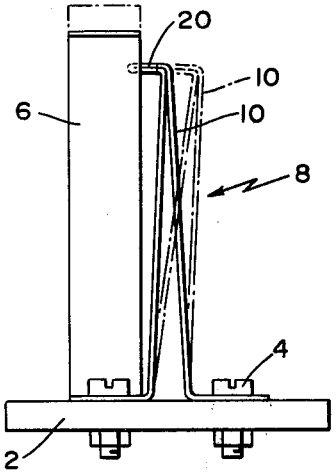
FIG. 4
FIG. 6
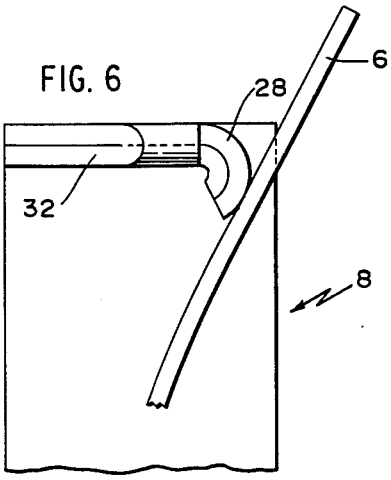
FIG. 7
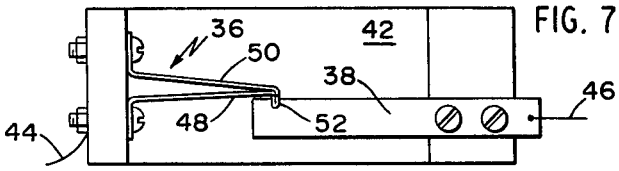
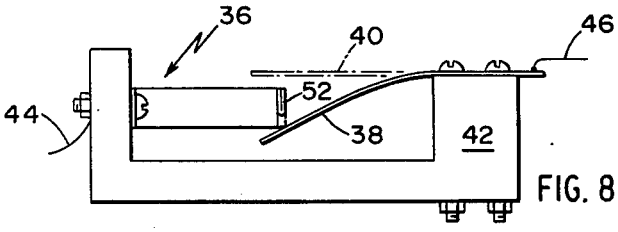
FIG. 8

FIG. 19
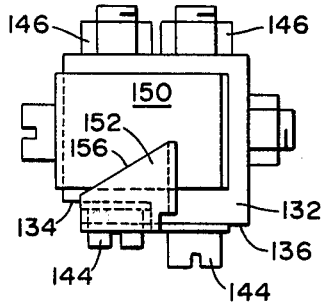
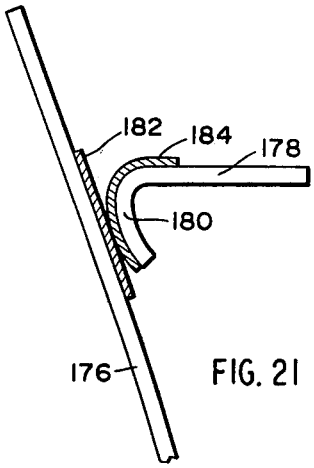
FIG. 21
FIG. 17
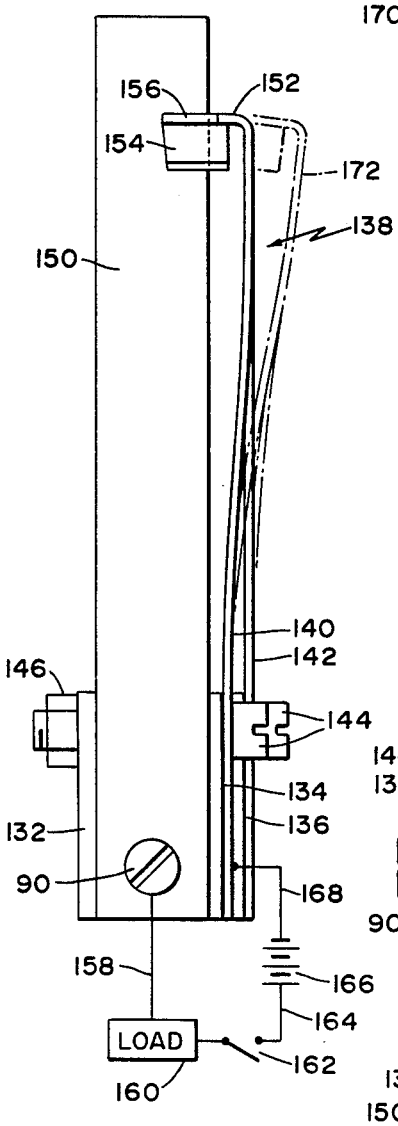
FIG. 18
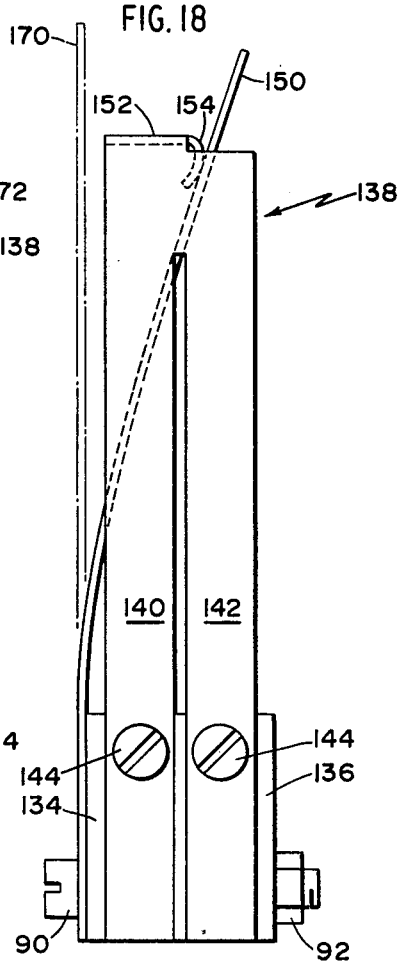
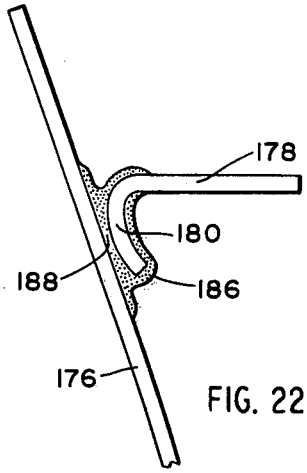
FIG. 22
FIG. 20
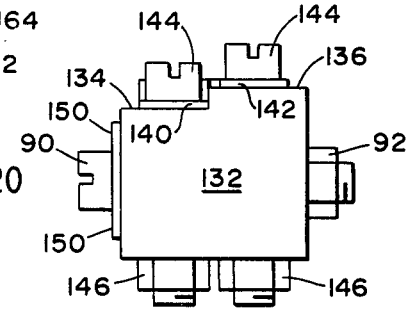

AMBIENT-COMPENSATED CIRCUIT BREAKER

BACKGROUND OF THE INVENTION

Attempts have been made to manufacture low cost, ambient-compensated current-actuated small circuit breakers, and particularly such devices which have relative freedom from chattering of the contacts, and good maintenance of contact pressure up to the point of contact separation. Almost invariably, the cost of such structures has been too high for wide acceptance by the mass markets, such as circuit breakers for the automobile industry. The reasons for this are many, but among them are the high cost of labor used in making the devices and the high cost of the materials of the circuit breaker. In addition, due to the vibration encountered in automobiles, and the wide range of ambient temperatures that automotive circuit breakers encounter during usage, it has been difficult to make satisfactory circuit breakers which are low enough in cost to sell in the automotive field.

In present day automobiles, for reasons of economy of installation and wiring, often a fuse panel will be installed which has on it many individual fuses. As to the panel, each fuse thereon requires two spring clips which must be riveted to the panel; and each fuse requires a body, end caps, and the fuse link itself. It takes many operations to assemble (from basic materials and parts) such a fuse and its clips. Again, labor costs for such steps tend to increase the cost of the finished panel and the fuses therefor.

It is known to use a thermostat metal blade to engage the end of a spring arm. The thermostat blade, when heated by current flowing therethrough, will bend insuch manner as to release the spring arm so that the latter may move to open electrical contacts. However, in many such structures, there is no ambient compensation; and in most if not all such circuit breakers, contact pressure diminishes gradually as current passes through the device, thus permitting chattering of the contacts. Most of these designs in the prior art have been constructed in order to be serviceable on voltage circuits such as 110 v. A.C. or 220 v. A.C. Because of the requirements of the Underwriters Laboratory in respect to the performance of such devices, such prior art breakers are relatively expensive to construct and therefore costly to buy. As examples of these devices attention is drawn to the following U.S. Pat. Nos.: Jackson et al. 2,270,950; Frank et al. 2,320,355; Ingwersen 2,492,382; Millen 2,615,963; and Lombardo 2,844,690.

In addition, prior art devices in which a thermostatic blade must wipe across a spring arm during the circuit opening period, have the difficulty that the coefficient of friction between the spring arm and blade may vary from unit to unit, or may become variable during use. This gives rise to initial faulty calibration, or erratic calibration during use.

SUMMARY OF THE INVENTION

It is the general purpose of this invention to provide a low cost, ambient-compensated, thermally actuable, manually-resettable circuit breaker having a minimum of parts, minimum of assembly costs, a minimum of calibration costs, and minimum of contact chattering during usage; and a circuit breaker in which variations in calibration and current ratings are minimized.

Therefore, among the several objects and provisions of this invention may be noted the following:

One object of the invention is the provision of a low-cost, simple, ambient-compensated, thermally actuable circuit breaker using minimum parts in its total assembly.

Another object of the invention is the provision of a circuit breaker of the above kind with means for assembling the operating parts thereof on a base involving a minimum of skill, labor and calibration costs.

Still another object of the invention is the provision of a circuit breaker of any of the above kinds in which simple but novel means are provided whereby accuracy of calibration is assured.

Other objects and advantages will be in part obvious and in part pointed out hereinafter.

The invention accordingly comprises the elements and combinations of elements, features of construction, and arrangements or parts which will be exemplified in the structures hereinafter described, and the scope of the application of which will be indicated in the appended claims.

Referring now to the drawings, in which are shown several embodiments of the invention:

FIG. 1 is an illustration of a first embodiment, showing the actuating and contact members in open position.

FIG. 2 is a plan view of the embodiment of FIG. 1 but with the actuating and contact members in contact closed position.

FIGS. 3 and 4 are elevations of the first embodiment, illustrating the position of the actuating and contact members in the contact closed position of FIG. 2.

FIGS. 5 and 6 are respectively plan and elevation views of portions of actuating and contact members similar to those of FIGS. 1–4 except for a different formation of a contact member thereof.

FIGS. 7 and 8 are plan and elevation views, respectively, of a second embodiment of the invention, showing the respective operating members thereof arranged in different spacial relationships to each other.

FIGS. 17 and 18 are side and front elevations, respectively, of a fifth embodiment of the invention with the actuating members of the invention in contact closed position.

FIGS. 19 and 20 are, respectively, top bottom views of fifth embodiment with the members thereof in the FIG. 18 position.

FIGS. 21 and 22 are illustrations showing two alternative contact formations, these formations being applicable to any of the above embodiments.

Similar reference characters indicate corresponding parts throughout the several views of the drawings; and dimensions of certain of the parts as shown in the drawings may have been modified and/or exaggerated for the purposes of clarity of illustration and understanding of the invention.

Figure 11:
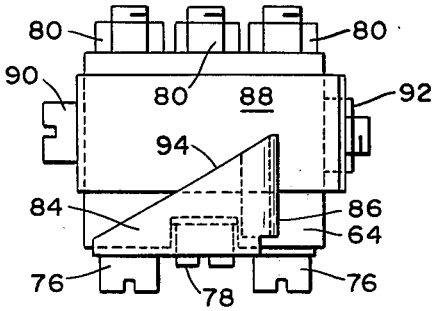
FIGS. 11 and 12 are respectively top and bottom views of the third embodiment with the members thereof in the FIG. 10 position.

Referring to the first embodiment of the invention as shown in FIGS. 1–4, a base 2 of electrical insulating material is provided on which are mounted by suitable attaching means such as screws 4 threading into the base, the actuating elements of the embodiment, comprising a flexible spring member 6 in strip form and an electrical current sensitive member indicated generally by numeral 8. Member 8 comprises two legs 10 and 12 joined at the top 14 as shown, the member being formed preferably by bending a strip of metal back upon itself to form the two legs. The top portion 14 of the legs is bent over at an angle to the legs to form the latch 16; and when bottom ends of the legs are spread apart, as ahown, to establish the illustrated divergent relationship of the legs and thus form the rigid triangular configuration, the latch 16 is preferably at right angles to a line perpendicular to the base, although variations of this angle are permissible. The latch portion 16 is cut away to form the cam surface or edge 18, and the combined latch and contact portion 20.

Since the basic principles of operation of this embodiment are those of the remaining embodiments, an explanation of the operation of this embodiment will now be given:

FIG. 1 shows the elements in their open, non-contact position. FIGS. 2, 3, and 4 show the elements in their engaged, contact-making position, with FIG. 4 showing in dotted lines 10 the thermally flexing element 8 in its open or unlatched position. In order to reset the device from the FIG. 1 position, the spring arm 6 is manually pushed so that it bears against the cam-edge or portion 18 and continues its motion. The resulting cam action forces the latch member 8 to the right (as viewed in FIG. 1) to the point that the spring arm 6 at its upper portion moves beyond the latch edge 20. At this point, member 18 (because of its innate resilience) will move back to the position of the parts shown in FIGS. 3 and 4.

Specifically, FIG. 3 shows the spring arm 6 moved far enough so that the latch portion 16 of member 8 has thus moved far enough so that the latch face 20 can engage the spring arm to hold it in the resiliently biased position shown. In this position, electrical contact is made between the cam-edge 20 and the upper face of the spring arm 6 to complete a circuit (see FIG. 1) comprising a switch 22, load 24, and battery 26 (for example, the battery of an automobile). Switch 22 is manually operated, and when closed places the load across the battery through the contacts between the cam-edge 20 and the upper portion of the spring arm 6, current flowing through leg 12 and arm 6.

The parts remain engaged until an overload occurs due, for example, to a short circuit somewhere in the circuit. As a result, the overload current now flowing through the leg 12 heats the latter more than leg 10 which is heated only by the ambient air temperature, and leg 12 elongates due to thermal expansion. As a result, due to the elongation of the leg 12, the latch 16 of the structure 8 is moved to the right (as viewed in FIG. 1) thus moving the latch face 20 along the face of the spring arm 6 toward release position. Eventually, latch 16 is moved far enough to release the arm 6 which moves resiliently to the contact-open FIG. 1 position. In FIG. 4, the current sensitive element 8 is shown moved to the right sufficiently enough to free the spring arm 6. As a result, the current to the load is interrupted.

It will be noted that the operation of the latch face 20 in being drawn along the face of arm 6 is set forth and taught in my co-pending U.S. patent application Ser. No. 409,911, now issued Oct. 14, 1975 as U.S. Pat. No. 3,913,049, the teaching of which patent as to this point is incorporated herein by reference. The motion of the member 8 is such as to move the latch edge 20 in a direction parallel to its length. Thus, the edge 20 forms in essence "knife-edge" (albeit dull one) as it rests against the face of the spring arm 6, and the motion of the "knife-edge" as it is drawn across the face is one which has a minimum amount of friction as compared to the friction that would exist if the face 20 were to be moved across the face of arm 6 in a direction perpendicular to the latch edge. Also, as set forth in said U.S. patent given above, as the latch edge 20 moves toward the release or unlatching position, the contact pressure between the residual portion of the latch edge and the spring arm at any given moment of the motion. This is an important feature.

Upon opening of the circuit, current ceases to flow through the leg 12, and as a result leg 12 cools, contracts and the latch 16 moves back to the position of FIG. 1 with no electrical contact between the latch and the spring area. In order to reset the device, the switch 22 is opened, and then the spring arm 6 is moved against the cam edge as set forth above, until the latching position is reached.

Referring to FIGS. 5 and 6, a variation of the first embodiment is shown, differing only in respect to the formation of the latch edge on the structure 8. In this instance, the bent over portion 16 is so formed that a portion 28 thereof is curled to form the cylindrical surface as illustrated in FIGS. 5 and 6, and it is this cylindrical surface of portion 28 that meets the face of the spring arm 6 tangentially. Since the face of the portion 28 is cylindrical, it meets the flat face of the spring arm 6 along a line, thus simulating the knife-edge structure discussed above. As a result of this, there is minimum friction as the structure 8 moves the latch portion 28 in a direction parallel to the tangential line. In addition, contact pressure is increased moment by moment as the face 28 moves (during a short-circuit condition) toward an unlatching position, up to the point of release at which contact pressure drops instantly to zero. As in the prior embodiment, a cam surface 32 is formed on the end portion which is used in conjunction with one edge of the spring arm to reset the device.

Referring now to FIGS. 7 and 8, a second embodiment of the invention is shown in which the current sensitive element 36 engaging the spring arm 38 in contact-closed position. FIG. 8 is an elevation of FIG. 7, showing in full lines the contacts closed, and in dotted lines 40 the position of the spring arm 38 when the elements are tripped to contact-open position. The elements are mounted on a base 42 of electrical insulating material, which is shown using suitable mounting screws, and lead wires 44 and 46 are used to connect the device to a battery 26, a switch 22 and a load 24, all just as in FIG. 1.

Viewed in FIG. 7, when current passes through the leg 48 of the current sensitive device 36, this leg elongates in respect to leg 50 (through which no current flows), with the result that the latch portion 52 (corresponding to the latch portion 14-18-20 of FIG. 1) is moved upwardly as viewed in FIG. 7. The latch edge eventually leaves the spring arm 38, and the spring arm is thus enabled to move away as shown by dotted lines 40 in FIG. 8 to open the contacts.

In both the first and second embodiments, it is to be noted that the current sensitive elements 8 and 36 are ambient compensated. That is if the temperature of the air surrounding the legs 10 and 12 of FIG. 1 (and FIGS. 5 and 6), and the legs 48 and 50 of FIG. 2 rises or decreases the motion the latch portions 16 and 52 of these embodiments will not move because the elongation of the legs 10 and 12 and 48 and 50, respectfully, are the same with the result that there is no "differential" motion to shift the latch engaging edge away from the face of the respective spring arms 6 and 38.

It will also be noted that in the FIGS. 1–8 embodiments, the current sensitive structures 8 and 36, respectfully, are bipods. That is, each element consists of a leg through which current is passed and one other leg through which no current is passed, these two legs being of the same metal, and having the same co-efficients of thermal expansion, so that the bipod structure is ambient compensated as set forth above.

Referring now to FIGS. 9–12, a third embodiment of the invention is shown, in which a tripod or three-legged arrangement is set forth, which operates basically as does the first two embodiments. In this case, the tripod structure indicated generally by numeral 54 is made from a flat piece of monometal in which a pair of slits 56 are provided, thus forming outer legs 58 and 60, and inner leg 62. A base 64 is provided, into which is provided along one side thereof a slot 66. Slot 66 is wide enough to receive therein the end portion 68 of inner leg 62. The ends 70 and 72 of the outer legs 58 and 62, respectfully are mounted against side portions 74 of the base adjacent the slot. Fastening screws 76 pass through suitable holes in the ends of the legs 58–62, through the base 64, and are engaged by the nuts 80 on the other side of the base in conventional manner to anchor the structure 54 by its ends to the base 64.

As thus mounted, it will be observed (see FIGS. 9, 11 and 12) that the center leg 62 has now been mounted so as to be out of the plane of the outer legs 58 and 60, so that a tripod is formed consisting of the flat strip blades 58, 60, and 62.

Figure 9:
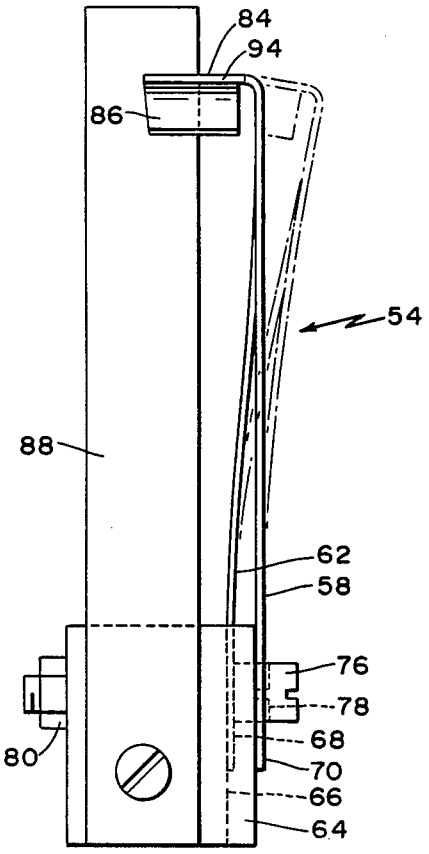
FIGS. 9 and 10 are side and front elevations, respectively, of a third embodiment of the invention with the actuating members in contact closed position.
Figure 10:
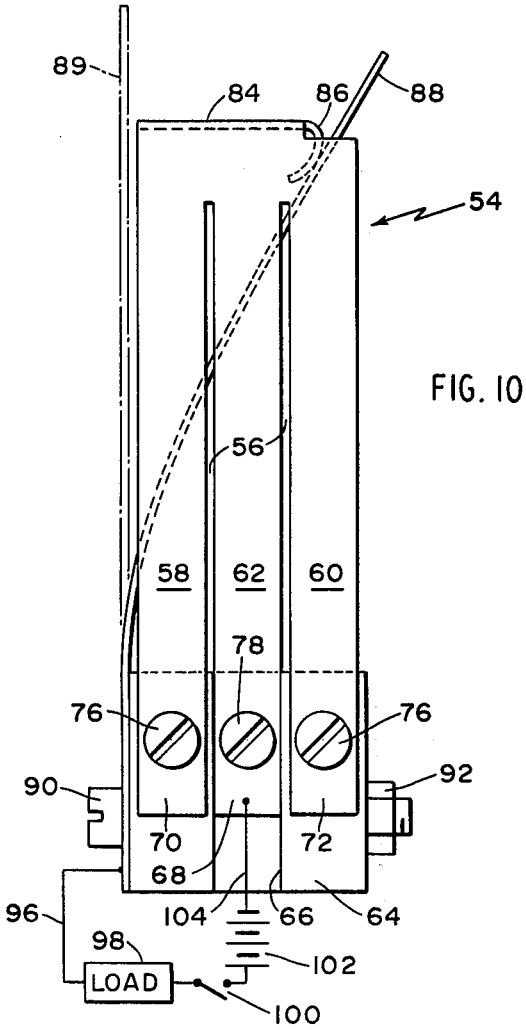
Figure 12:
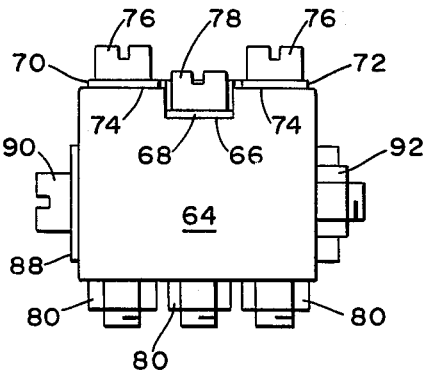
Figure 15:
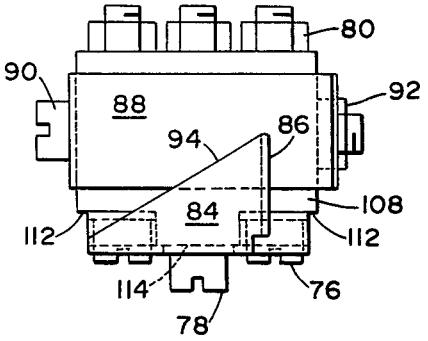
FIGS. 15 and 16 are, respectively, top and bottom views of the fourth embodiment with the members thereof in the FIG. 14 position.

The upper end of the blades where they remain integrally fastened together, is bent over to form the latch portion 84, the latter being preferably at right angles to the length of the structure 54. As shown in FIGS. 5 and 6, the end 86 of the bent-over portion is curled into a cylindrical shape, as shown, in order to make a line engagement with the face of a spring arm 88 which is mounted as shown on one side of the base by a nut and bolt 90, 92. FIGS. 9 and 10 show in full lines the parts in contact-closed position with the current sensitive element 54 latched and in engagement with the spring arm 88 which, as in the previous embodiments is resiliently biased to the left (as viewed in FIG. 10), when in the contact-closed position. The contact open position of the parts is shown by the dot-dash line 89 after the latch has been moved by current through the device to release the spring arm. The latch member 84 is provided with a cam surface 94 as in the previous embodiments in order to reset the part from the position shown by the dot-dash line in FIG. 9 to the full line, the end of the spring arm being manually moved, against its bias, to the right as viewed in FIG. 10, and as the edge of it slides along the cam 94, the current sensitive member 54 is moved to the right (as viewed in FIG. 1) until the position is reached at which the spring arm is beyond the cylindrical portion 86, at which point the resilience of the current-sensitive member 54 will snap it back into the position shown in full lines in FIG. 9. When the spring arm is now released, it will come to bear against the cylindrical latch surface 86 and make a line engagement therewith.

The circuit for the device is the same as that given in the first two embodiments, the spring arm being connected by a lead wire 96 to a lead 98. The other side of the load is connected by suitable lead lines to a switch 100 and thence to the battery or other power source 102. The latter is connected by a lead line 104 to the end of the center leg 62.

The operation is the same as that described in the first two embodiments. For normal use, switch 100 is closed and as long as there is not shorting or over load will be operated satisfactorily. (For example, the load can be the headlamps of an automobile.) However, if an overload occurs, then current will traverse the lead wire 104, center strip 62, latch portion 86, spring arm 88, and thence by lead wire 96, load 98 and switch 100 back to the power source 102. As a result of this, the center leg will become heated by the current to a greater degree than the two outer legs, and the elongation of the center leg due to the thermal coefficient of expansion will cause the current sensitive member 54 to move to the dot-dash line position as shown in FIG. 9, thus drawing the cylindrical latch 86 away from the spring arm and releasing the latter to move to the contact open position shown by the dot-dash line 89 in FIG. 10. As in the previous embodiments, as the latch 86 is moved along the face of the spring arm toward a latch releasing, contact-opening position, contact pressure increases steadily until the latch is moved far enough to free the spring arm. When the over-load condition has been corrected, the parts are moved into engagement again as shown in FIG. 10, in the manner described above.

Figure 16:
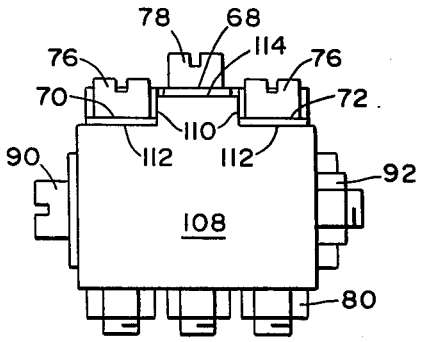

Referring now to FIG. 13–16 for a fourth embodiment of the invention, a base 108 is shown along one side of which are provided rabbets 110 this providing the recessed faces 112 as shown (see FIG. 16). There is thus left a land 114 extending along the same side of the base. The current sensitive structure 54 is the same as that shown in FIG. 10, having outer legs 58 and 60, and inner leg 62. However, in this instance in order to form the tripod, the outer legs are fastened against the faces 112, and the center leg is fastened against the land 114. As a result of this, the legs are displaced to form a tripod, but the general plane of the inner leg is now displaced away from the spring arm (to the right as viewed in FIG. 13) instead of being displaced to the left and toward the spring arm as in FIGS. 9–12. The structure 54 is provided with the bent over latch end 84 which is provided with the cylindrical curved contact portion 86 just as in the FIGS. 9–12 embodiment. The legs of the structure 54 and the spring arm 88 are fastened to the base using conventional means such as the nut and bolt construction 76. 78, and 80. The end of the spring arm is fastened to the base by the nut and bolt 90, 92.

Figure 13:
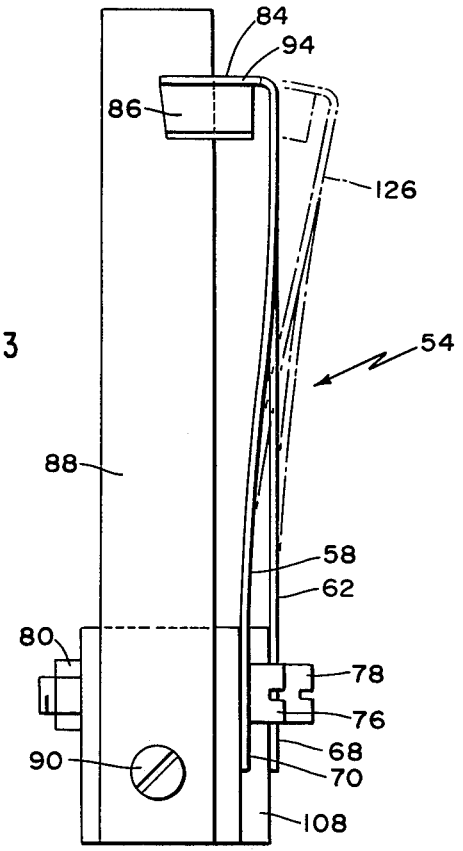
FIGS. 13 and 14 are side and front elevations, respectively, of a fourth embodiment of the invention, similar in some respects to the third embodiment, but with certain elements arranged differently, the actuating members being shown in contact closed position.
Figure 14:
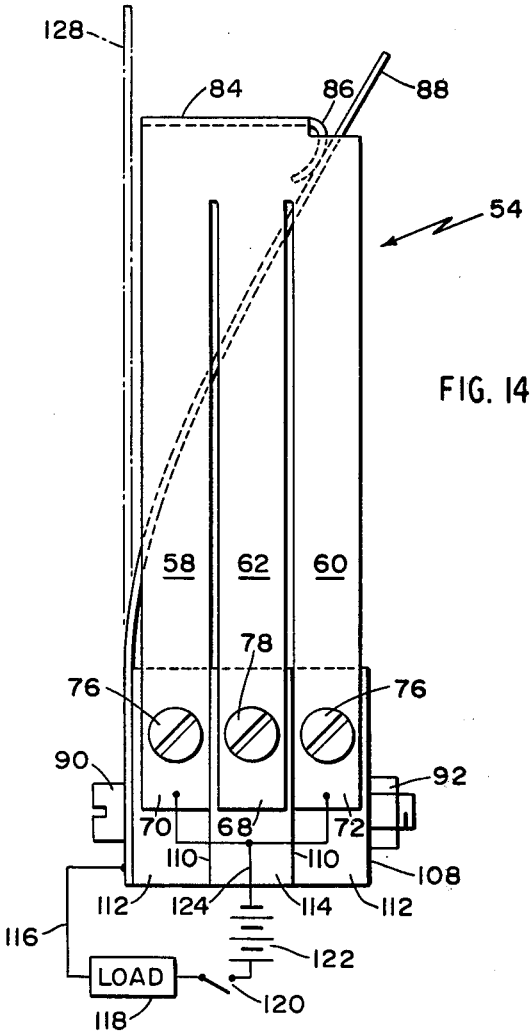

One of the functions of the embodiment of FIGS. 13–16 is to provide a circuit breaker having a higher rating than that of FIGS. 9–12, but using the same current-sensitive structure 54. To this end, the end of the spring arm is connected by the lead line or wire 116 to the load 118 (which may be automobile headlights) and the load connects to the headlight switch 120. Switch 120 is connected to the power source 122 and the latter is then connected by the lead lines 124 to the outer legs 58 and 60 in parallel. When, now, a short circuit occurs, it is the outer legs which will be heated by the current with the center leg remaining relatively at ambient temperature. As a result of this, the outer legs will elongate (due to the thermal coefficient of expansion) with the result that the current sensitive structure 54 is pushed to the right as shown in FIG. 13 to the dot-dash line position 126, thus unlatching the spring arm and allowing it to move by its own resilience to the dot-dash line position 128, (see FIG. 14), thus opening the circuit.

As in the previous embodiments, as the cylindrical latch is moved to the right under the influence of the elongation of the outer legs 58, 60, cylindrical latch is drawn along the face of the spring arm in the direction of the line engagement, thus minimizing the effects of frictional components, and also causing the contact pressure to increase up to the exact moment of release. Again, just as in the previous embodiments, the device is ambient compensated because any change in the ambient temperature will result in heating the legs 58, 60 and 62 equally so that the position of the latch member 84, 86 will not change.

The bent over latch portion 84 is provided with the cam edge 94, as in the previous embodiments, and the device is reset as described above for the other embodiments.

Referring now to FIGS. 17-20 for a fifth embodiment of the invention, a base 132 is provided, along one face thereof is provided rabbet 134, thus leaving a land 136. The current sensitive element 138 is made by slitting a flat strip of monometal, as shown, to form two legs 140, 142, instead of three as in the previous embodiment. These legs are fastened to the base by conventional nut and bolt structures 144, 146, respectively, with leg 140 seated in rabbet 134 whereas the leg 142 is mounted along land 136. As a result, legs 140, 142 are displaced from each other to form a bipod as shown in the drawings.

A spring arm 150 is attached to another face of the base as shown, and held thereon by means of nut and bolt 90, 92.

The upper end of the structure 138 is bent over to form the latch 152 a portion of which is bent to form the cylindrical latch surface 154. The latch 152 is provided with a cam edge of 156, and the cylindrical latch portion 154 makes a line contact with the face of spring arm 152 when these two members are in contact or latched position as shown in FIGS. 17 and 18.

In this embodiment, the circuitry is as follows: A lead wire of 158 connects the spring arm 150 to load 160. The load is connected to the switch 162 and the latter is connected by the lead wire 164 to the power source 166. The latter is connected by lead wire 168 to the leg 140 which is the one nearest the spring arm as viewed in FIG. 17. For normal use, the load (such as automobile headlights) is connected on and off by means of the switch 162. If the switch is closed and an overload occurs in the circuitry, then excess current will flow through the leg 140 (but not the leg 142). The heat engendered in the leg 140 will cause it to lengthen due to its thermo co-efficient of expansion, with the result that the latch 154 will be moved away from the spring arm, allowing the latter to move to the contact-open position shown in FIG. 18 by dot-dash lines 170.

As in the previous embodiments, the contact portion 154 makes a line engagement with the face of the spring arm, thus reducing frictional components, and as the structure 138 moves its contact face 154 toward contact-open position the contact pressure between the portion 154 and the spring arm 150 steadily increases up to the actual moment of release when the structure 138 has moved to the position 172.

Referring now to FIGS. 21 and 22, other contact structures per se may be employed in any of the embodiments of this invention, instead of using just portions of the spring arm and the latch as the contacts. The use of the latter will provide the most economical device which can be made. However, for higher current ratings and longer life, other possible contact are now described.

Referring first to FIG. 21, a spring arm 176 which can be any of the spring arms of this invention is shown, and the bent over latch 178 is shown which can be any of the previous latches. Preferably, the latch 180 will be cylindrical as shown in FIGS. 5, 9, 13, and 17. Mounted on the spring arm 176 by contact metal (such as contact silver) piece 182. A layer of silver 184, forming the other contact face, is mounted on the curved surface 180 of latch 178 by any conventional means (such as silver soldering or welding). Since the silver member 184 has a cylindrical face, a line contact with contact 182 is thus provided as has been described above.

Referring now to FIG. 22, instead of the silver contacts, spring arm 176 and the latch portion 178 of the current sensitive element are now held in latch engaging position by a layer of low melting point solder 186. It is preferred that a thin layer of the solder 188 lie between the cylindrical surface 180 and the face of the spring arm; however, this is not necessary. The function of the solder is two-fold: first, the solder joint reduces contact resistance that might occur between the cylindrical portion 180 and the spring arm 176; secondly, the solder prevents chattering of these contacts, if the device is mounted on a body which vibrates. However, when sufficient over-load current passes through the device so that the latter needs to open its contacts, the current will be sufficient to melt the solder 188, thus permitting freedom of the parts to separate. That is, the melting point of the solder 186 must be such that while it will remain "frozen" or solid during normal currents flowing through the circuit breaker, it must melt immediately if the rated interrupting current of the circuit breaker is reached.

Figure 23:
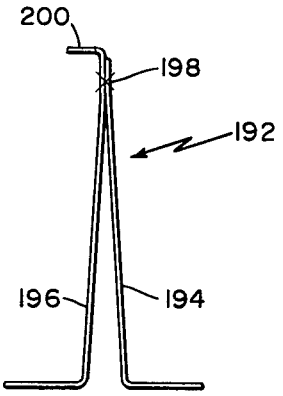
FIG. 23 is a side elevation of a sixth embodiment of the invention.

Referring now to FIG. 23, a side elevation of a sixth embodiment of the invention is shown which is like the embodiment of FIGS. 1–4, except that the current-sensitive structure indicated generally by numeral 192 is, in this embodiment, formed of two separate pieces instead of being formed entirely of one piece. The two pieces are the strips 194 and 196 corresponding to the strips 10 and 12 respectfully. They are fastened together at their upper ends by means of a weld or rivet 198, and when the legs are diverged from each other as in FIG. 1, they form a rigid bipod. As in FIG. 1, the upper end of the leg 196 is bent over at (preferably) right angles to form the latch member 200. Other than these details, the structure and circuit connections for this sixth embodiment are the same as in FIG. 1.

Figure 24:
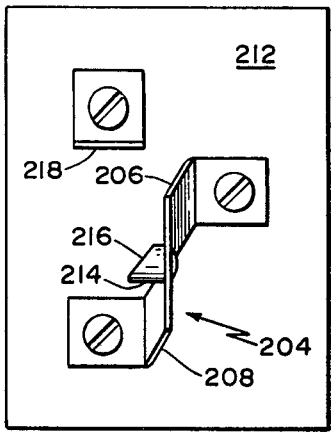
FIG. 24 is a top plane view of a seventh embodiment of the invention, illustrating (together with FIGS. 25 and 26) a different form of one of the actuating members of the invention, the actuating members being in contact closed position.
Figure 25:
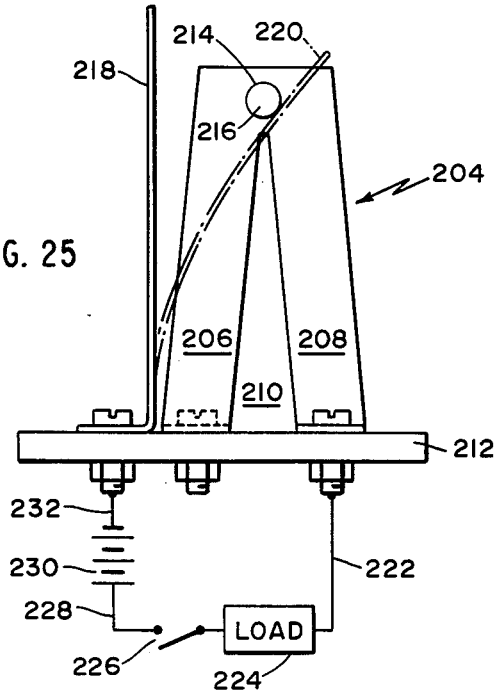
FIGS. 25 and 26 are front and side elevations of the seventh embodiment.
Figure 26:
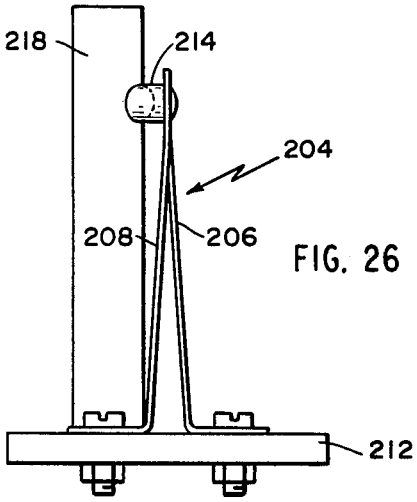

Referring now to FIGS. 24–26, a seventh embodiment of the invention is shown. Referring first to FIG. 24, a front elevation of the device, a current-sensitive element indicated generally by numeral 204 is shown. In this instance, the element is a bipod, and the two legs 206 and 208 which are integral parts of an original flat piece of monometal. The legs are formed by cutting a triangular shaped slot 210 in the original piece. The bottom ends of the legs are bent over as in FIGS. 1 and 23, and by means of these bent over portions, the element 204 is attached to a base 212, with the legs spread apart. Thus, in this embodiment the legs are divergent in each of two directions.

In this embodiment, instead of bending over the top portion of the element 204, a separate contact 214 is provided which may be a silver contact riveted to the top end of the element. The contact is provided with a cam surface 216 which, in the operation of the device, will serve the same function as the cam edges provided on the other embodiments. It will be noted that the contact 214 may conveniently be a portion of a cylindrical contact-metal or rod.

A spring arm 218 is provided which is shown in full lines in FIG. 25 in the contact-open (latch-disengaged) position, the dot-dash line 220. In the contact engaged position, it will be noted that because of the cylindrical surface of the contact 214, a line contact is made between the contact 214 and the face of the spring arm. As before, the spring arm is of resillient metal such as tempered beryllium copper, or phosper-bronze; of course, other spring materials may be used which have electrical characteristics such that they will make good electrical contact with another metal.

Circuitry for the embodiment of FIGS. 24–26 device is as follows: a lead wire 222 attaches the arm 208 to the load 224 which is connected to a switch 226 for operating the load under normal conditions. A lead 228 connects the other side of the switch to the power source 230 such as an automobile battery, and lead 232 connects the other side of the power source to the spring arm 218. Under normal conditions with the switch 226 closed, current flows through arm 208 raising its temperature somewhat but not sufficiently to move the current-sensitive element 204 far enough to disengage the spring arm. The current then flows through the spring arm to the power source and back to the load. However, if an over-load occurs, excess current will flow in the arm 208 which will heat and elongate due to a thermal co-efficient of expansion, with the result that is moves the latch member 204 to move the compact 214 away from the spring arm 220, thus unlatching the latter so that it moves to the contact-open position shown in FIG. 25 and FIG. 26. The device is closed by moving arm against cam face 216 thus forcing the structure 204 away from the arm until the arm moves beyond contact 214. The latch then snap back over the spring arm.

In all of the embodiments, it will be noted that the actuating elements are monometallic. By this means, the actuating elements can be made ambient compensated in utmost simplicity. Of course, if desired, instead of utilizing current passing through one of the legs of the devices, a heater wire can be wrapped around that leg which it is desired to expand or elongate to actuate the device, one end of the heating wire being connected to the power source and the other end of the heating wire being connected to that leg which is to be moved by the passage of current through. If desired, other forms of electrical contacts can be used, but for minimum change in calibration, and reduction in frictional components, it is preferred that the embodiments shown herein as to contact structure be those that are utilized. While the current sensitive elements and spring arms have been shown attached to their bases by means of conventional nut and bolt structures, it is quite obvious that other means such as rivets can be used for fastening. Or, as set forth in the above-mentioned U.S. Pat. No. 3,913,049, a cover can be provided and suitable slots etc. so that when the cover is attached to the base, the operating elements are held securely fastened to the base by the cover engagement with the latter.

In view of the above it will be seen that the several objects of the invention are achieved and other advantageous results attained.

It is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

As many changes could be made in the above constructions without departing from the scope of the invention, it is intended that all matter contained in the above description or shown in the accompanying drawings, shall be interpreted as illustrative and not in a limiting sense, and it is also intended that the appended claims shall cover all such equivalent variations as come within the true spirit and scope of the invention.

I claim:

1. An electrical circuit breaker comprising:

a base;

a first metal strip member having first and second end portions and being mounted on the base by said first end portion, the second end portion including a first electrical contact part, and the second end portion with its electrical contact part being resiliently biased to move from a first latched position to a second unlatched position;

a second metal strip member mounted on the base and comprising at least one pair of divergent legs having their upper ends joined together and their lower ends spread apart to form a triangle on the base, said lower ends being fixed on the base to maintain the divergence of said legs; the upper end portion of at least one of said legs including a second electrical contact part, the second electrical contact part being adapted to latch with and be in electrical engagement with the first electrical contact part when in the first latched position;

said first and second contact parts being electrically open when the first member is in its second unlatched position;

means for moving said second end from its second unlatched position into said first latched position in which said contact parts are electrically engaged; and means for making electrical circuit connections to the first end of the first member and to the lower end of said one of the divergent legs.

2. The circuit breaker of claim 1 in which the joined upper end portion is bent to form a latch portion to extend at an angle to the altitude of the triangle made by said divergent legs, the latch portion comprising said second contact.

3. The circuit breaker of claim 1 in which at least one of said first and second contact parts is an element separate from the member to which it is attached.

4. The circuit breaker of claim 2 in which said latch portion is provided with a second portion adapted to make a line contact with the first contact part.

5. The circuit breaker of claim 4 in which the joined upper ends of said divergent legs move when one of said legs is heated, to move said latch portion in a direction parallel to the direction of said line.

6. The circuit breaker of claim 1 in which the joined together upper end portion of said second member is adapted to move in a direction parallel to the plane of the first member and away from the first member when electrical current heats one of said divergent legs.

7. The circuit breaker of claim 1 in which the central longitudinal lines of said divergent legs lie in a common plane.

8. The circuit breaker of claim 1 in which the central lines of said divergent legs lie in a single plane perpendicular to the direction of motion of the first member when moving from its first latched position to its second unlatched position.

9. The circuit breaker of claim 1 in which the central line of said divergent legs lie in spaced parallel planes, each of the planes being perpendicular to the direction of motion of the first member when moving from said latch position to said unlatched position.

10. The circuit breaker of claim 9 in which said central lines also lie in planes which converge one toward the other.

11. The circuit breaker of claim 1 in which the central longitudinal lines of said divergent legs lie in planes converging toward each other in one direction, and lie in second planes which converge toward each other in a second direction.

12. The circuit breaker of claim 1 in which said second member has two outer legs and one inner leg, the legs having their ends joined at the top; and the outer legs lying in a common first plane, and the inner leg lying in a second plane, said planes being divergent from each other whereby the two outer legs are divergent from the center leg, the center leg being nearer to the first member when in the divergent position, and being adapted to be heated by current passing through it.

13. The circuit breaker of claim 1 in which the second member has two outer legs and one inner leg, the legs having their ends joined at the top the outer legs lying in a common first plane, and the inner leg lying in a second plane, said planes being divergent from one another whereby the two outer legs are divergent from the inner leg, to two outer legs being nearer to the first member when in the two outer legs being nearer to the first member when in the divergent position, and being adapted to be heated by current passing therethrough it.

14. The circuit breaker of claim 1 in which the second member is of two separate strip metal legs having their top portions joined.

15. The circuit breaker of claim 1 in which the first and second members extend in the same direction side by side with respect to each other.

16. The circuit breaker of claim 1 in which the first and second members extend in the same direction longitudinally with respect to each other.

17. The circuit breaker of claim 1 in which at least one of the first and second contact parts includes a separate metallic current-carrying member attached to the respective member.

18. The circuit breaker of claim 16 in which each of the first and second contact parts includes a separate metallic current-carrying member attached thereto.

19. The circuit breaker of claim 18 having a predetermined current rating in which the separate metallic member comprises a layer of solder joining said first and second contact parts, the solder being adapted to be melted by the passage of current through the circuit breaker above the rated current.

20. An ambient compensated circuit breaker comprising at least two elongated strips of metal each strip having a first and a second end; the first ends of each being joined together, the strips being divergent from each other in a direction away from the joined ends and the second ends of the strips being fastened to a base thereby to maintain a divergence during operation of the circuit breaker a latch member extending generally at right angles from the first ends of the strips and generally perpendicular to the plane thereof, the latch member being movable with motion of said strips when heated, and a contact member engageable with the latch member to complete and electrical circuit, at least one of the latch member and the contact member being an elongated edge of the respective member, the motion of said strips toward a contact opening direction causing said elongated edge portion to be drawn along the other member in a direction parallel to the elongation of the latch member whereby during contact opening motion contact pressure is increased up to the point of separation of said members.

* * * * *

UNITED STATES PATENT AND TRADEMARK OFFICE

CERTIFICATE OF CORRECTION

PATENT NO. : 4,032,876

DATED : June 28, 1977

INVENTOR(S) : Lyndon W. Burch

It is certified that error appears in the above-identified patent and that said Letters Patent are hereby corrected as shown below:

Column 2, line 27, "tion." should be --tions.--;
line 61, insert --and-- between "top bottom".

Column 3, line 27, "ahown" should be --shown--.

Column 4, line 29, after "pressure", insert --increases--.

Column 5, line 17, insert a comma (,) after "That is".

Column 6, line 22, "lead 98" should be --load 98--;
line 29, "not" should be --no-- and "over load" should be --overload, the load--.

Column 8, line 41, delete "the".

Column 9, line 13, "and the" should be --and has the--.

Column 12, lines 10-11, delete "two outer legs being nearer to the first member when in the";
line 48, "and" should be --an--.

Signed and Sealed this

*Seventh* Day of *February 1978*

[SEAL]

*Attest:*

RUTH C. MASON
*Attesting Officer*

LUTRELLE F. PARKER
*Acting Commissioner of Patents and Trademarks*